US006257948B1

(12) United States Patent
Silva

(10) Patent No.: US 6,257,948 B1
(45) Date of Patent: Jul. 10, 2001

(54) TALKING TOY WITH ATTACHABLE ENCODED APPENDAGES

(75) Inventor: Dana A. Silva, Gloucester, MA (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 09/352,436

(22) Filed: Jul. 13, 1999

(51) Int. Cl.[7] ..... A63H 3/16; A63H 3/28

(52) U.S. Cl. ..... 446/100; 446/301

(58) Field of Search ..... 446/97, 98, 99, 446/100, 101, 297, 296, 299, 300, 301, 302

(56) References Cited

U.S. PATENT DOCUMENTS

| | | | | |
|---|---|---|---|---|
| 1,211,590 | * | 1/1917 | Kennedy | 446/99 |
| 1,223,508 | * | 4/1917 | Meyner | 446/97 |
| 3,447,249 | | 6/1969 | Greger . | |
| 4,038,775 | | 8/1977 | Sato . | |
| 4,176,492 | | 12/1979 | Sims et al. . | |
| 4,205,850 | | 6/1980 | Craig . | |
| 4,280,809 | | 7/1981 | Greenberg et al. . | |
| 4,348,191 | | 9/1982 | Lipsitz . | |
| 4,363,482 | | 12/1982 | Goldfarb . | |
| 4,453,920 | | 6/1984 | Harte . | |
| 4,526,550 | | 7/1985 | Lurito . | |
| 4,820,233 | | 4/1989 | Weiner . | |
| 4,869,701 | | 9/1989 | Kawai et al. . | |
| 4,980,919 | | 12/1990 | Tsai . | |
| 5,069,458 | | 12/1991 | Washington . | |
| 5,120,065 | | 6/1992 | Driscoll et al. . | |
| 5,217,402 | | 6/1993 | Gross et al. . | |
| 5,269,529 | | 12/1993 | Clemente . | |
| 5,295,889 | | 3/1994 | Ejima . | |
| 5,334,022 | | 8/1994 | Kitagawa et al. . | |
| 5,607,336 | * | 3/1997 | Lebensfeld et al. | 446/98 X |
| 5,906,369 | | 5/1999 | Brennan et al. . | |

* cited by examiner

*Primary Examiner*—D. Neal Muir
(74) *Attorney, Agent, or Firm*—Marshall, O'Toole, Gerstein, Murray & Borun

(57) ABSTRACT

The invention is directed to a talking toy in the form of an animated figure having a plurality of appendages for detachably combining with the toy body and that plays voice messages upon recognizing combinations of particular appendages with particular locations on the toy body.

18 Claims, 10 Drawing Sheets

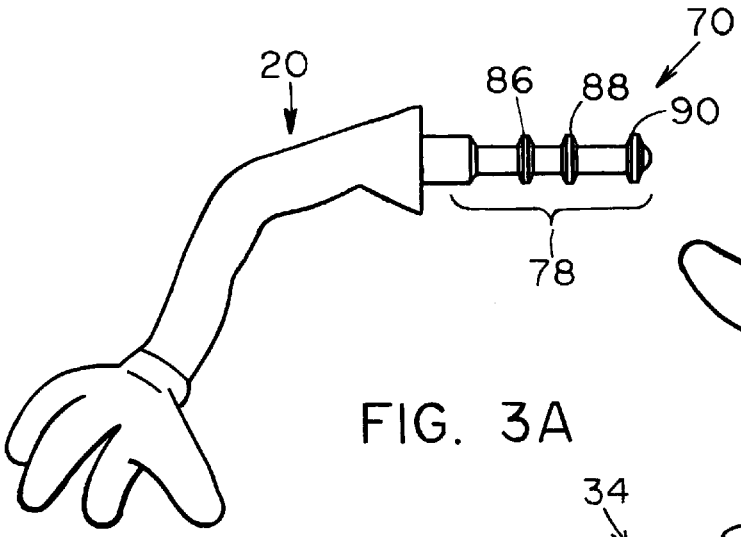
FIG. 3A
FIG. 3B
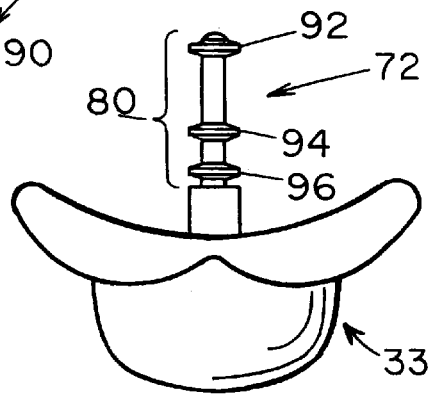
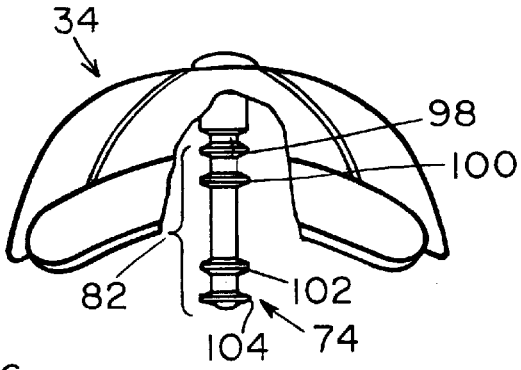
FIG. 3C
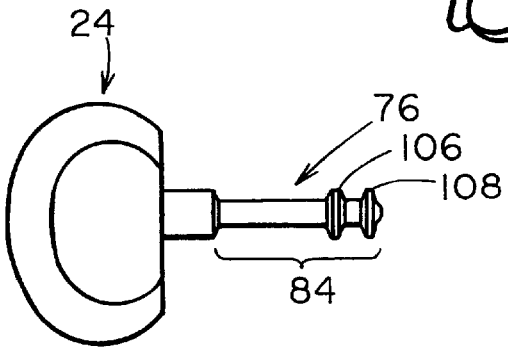
FIG. 3D
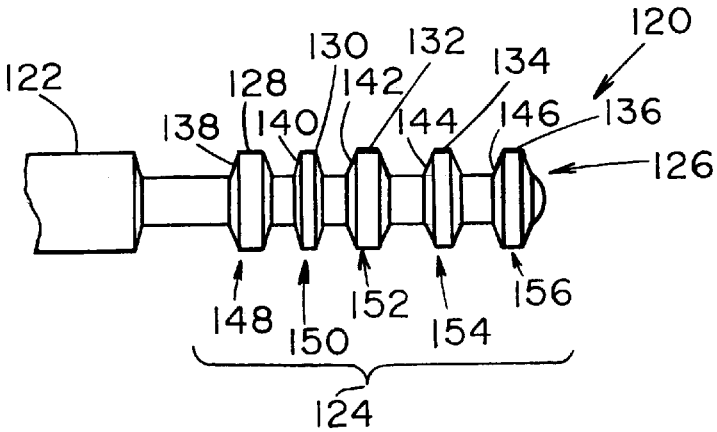
FIG. 4

| KEY LOCATION # | | 5 | 4 | 3 | 2 | 1 |
|---|---|---|---|---|---|---|
| 1) | Cowboy Hat | 1 | 1 | 1 | 0 | 1 |
| 2) | Baseball Cap | 1 | 1 | 0 | 1 | 1 |
| 3) | Pirate Hat | 1 | 1 | 1 | 1 | 0 |
| 4) | Lips | 1 | 1 | 0 | 0 | 1 |
| 5) | Teeth | 1 | 1 | 0 | 1 | 0 |
| 6) | Nose | 1 | 1 | 1 | 0 | 0 |
| 7) | Nose w/Mustache | 1 | 0 | 0 | 1 | 1 |
| 8) | Eyes | 1 | 0 | 1 | 0 | 0 |
| 9) | Eyelid Eyes | 1 | 0 | 1 | 0 | 1 |
| 10) | 2 Ears | 1 | 1 | 0 | 0 | 0 |
| 11) | Left Arm, Right Arm | 1 | 0 | 1 | 1 | 0 |
| | | | | | | |
| 12) | Unused | 1 | 0 | 0 | 0 | 1 |
| 13) | Unused | 1 | 0 | 0 | 1 | 0 |
| 14) | Unused | 1 | 0 | 1 | 1 | 1 |
| 15) | Unused | 1 | 1 | 1 | 1 | 1 |
| 16) | Unused | 1 | 0 | 0 | 0 | 0 |

FIG. 5

FIG. 8
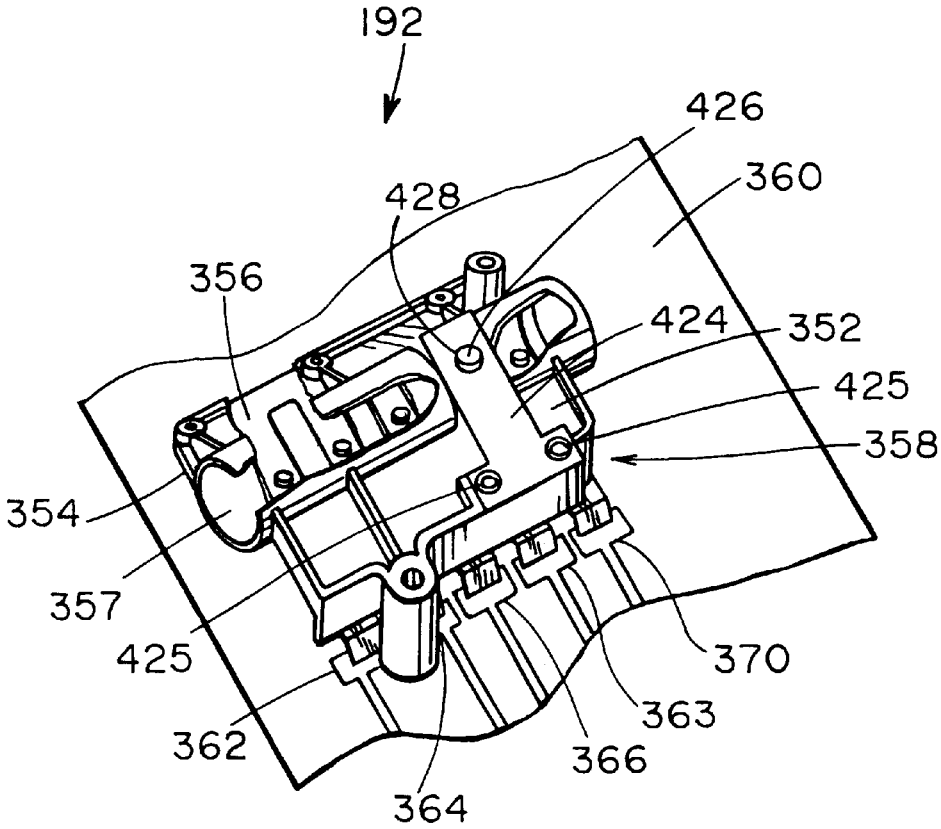
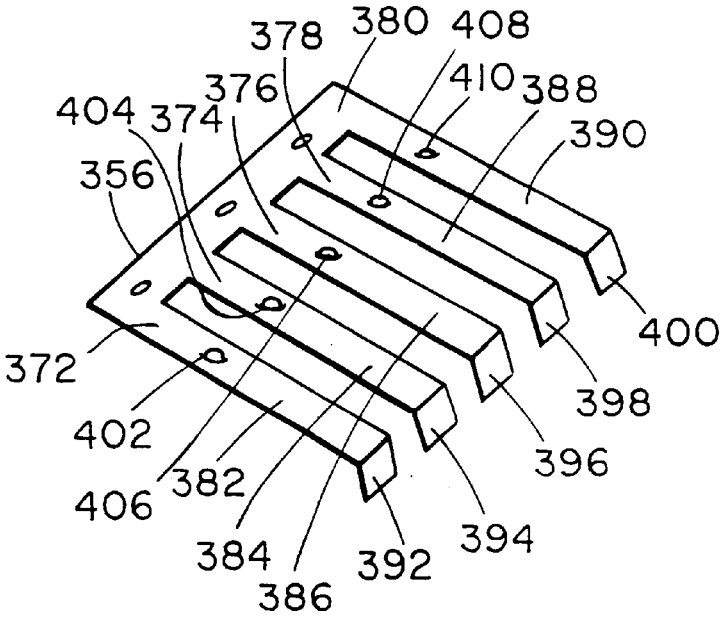
FIG. 9
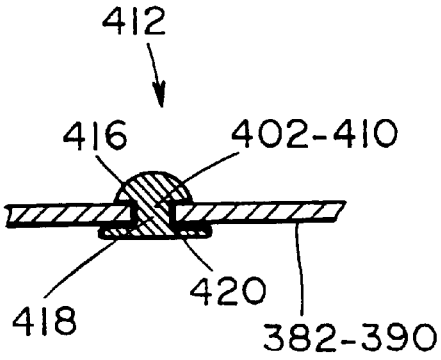
FIG. 10

TALKING TOY WITH ATTACHABLE ENCODED APPENDAGES

BACKGROUND OF THE INVENTION

The invention relates generally to a talking toy, and more particulary to a talking toy in the form of an animated figure having a plurality of appendages for detachably combining with the toy body and that plays voice messages upon recognizing combinations of particular appendages with particular locations on the toy body.

Various types of toys with detachable appendages have been previously designed. For example, U.S. Pat. No. 5,295,889 to Ejima discloses a toy in the form of a robotic humanoid that emits sounds and lights in response to the attachment/detachment of arms, legs, and a head to the toy body. As shown in FIGS. 2 and 5 of Ejima, the toy body includes apertures each having pairs of magnetized contacts. Each of the appendages includes an electrically conductive ferromagnetic hemispherical contact that may be magnetically attached to the toy body via the magnetized contacts to complete a current path across the magnetized contacts. A microprocessor disposed within the toy body detects the presence of an electrical path across the contacts and generates signals in response to a current flow through the magnetized contacts so that the toy body emits entertaining sounds and lights for a user.

SUMMARY OF THE INVENTION

The invention is directed to a talking toy in the form of an animated figure having a plurality of appendages for detachably combining with the toy body and that plays voice messages upon recognizing combinations of particular appendages with particular locations on the toy body.

The toy may include a hollow portion containing a source of battery power, a speaker, and an electrical circuit. The body portion may be shaped to represent an animated figure and may have a plurality of apertures of substantially the same size therein. The apertures may be associated with a plurality of predetermined locations on the body. A plurality of appendages for detachably combining with the body may be provided, wherein the appendages have key portions protruding therefrom, and the key portions are of substantially the same size so that each of the key portions fits in at least two of the apertures. A first circuit portion may be disposed within the body portion and adapted to recognize the presence of particular appendages in particular locations on the body, and a second circuit portion may be disposed within the body portion and have a plurality of voice messages associated therewith. The second circuit portion may be adapted to play the voice messages based on the combinations of particular appendages and locations.

In accordance with another aspect of the invention, a method of operating a talking toy having a body portion and a plurality of apertures therein, wherein each of the apertures adapted to detachably receive one of at least two appendages selected from a plurality of appendages, includes the steps of recognizing the presence on the body of a particular one of the appendages, determining the particular one of the apertures associated with the particular appendage, and providing a response to a user such that the response is uniquely associated with the combination of the particular appendage and the particular aperture.

The features and advantages of the invention will be apparent to those of ordinary skill in the art in view of the detailed description of the preferred embodiment, which is made with reference to the drawings, a brief description of which is provided below.

BRIEF DESCRIPTION OF THE DRAWINGS

FIGS. 3A–3D illustrate exemplary appendages for detachably combining with the body of the toy shown in FIGS. 1 and 2;

FIG. 4 illustrates a detailed elevational view of an exemplary key portion that may be used with the appendages shown in FIGS. 1 and 3;

FIG. 5 illustrates one possible assignment of binary codes to the appendages shown in FIGS. 1 and 3;

FIG. 8 illustrates a more detailed isometric view, partially in section, of the encoders shown in FIG. 6;

FIG. 9 illustrates a more detailed isometric view of the contact plate shown in FIG. 8;

FIG. 10 illustrates a fragmentary sectional view of the followers shown in FIGS. 8 and 9;

DETAILED DESCRIPTION OF A PREFERRED EMBODIMENT

Figure 1:
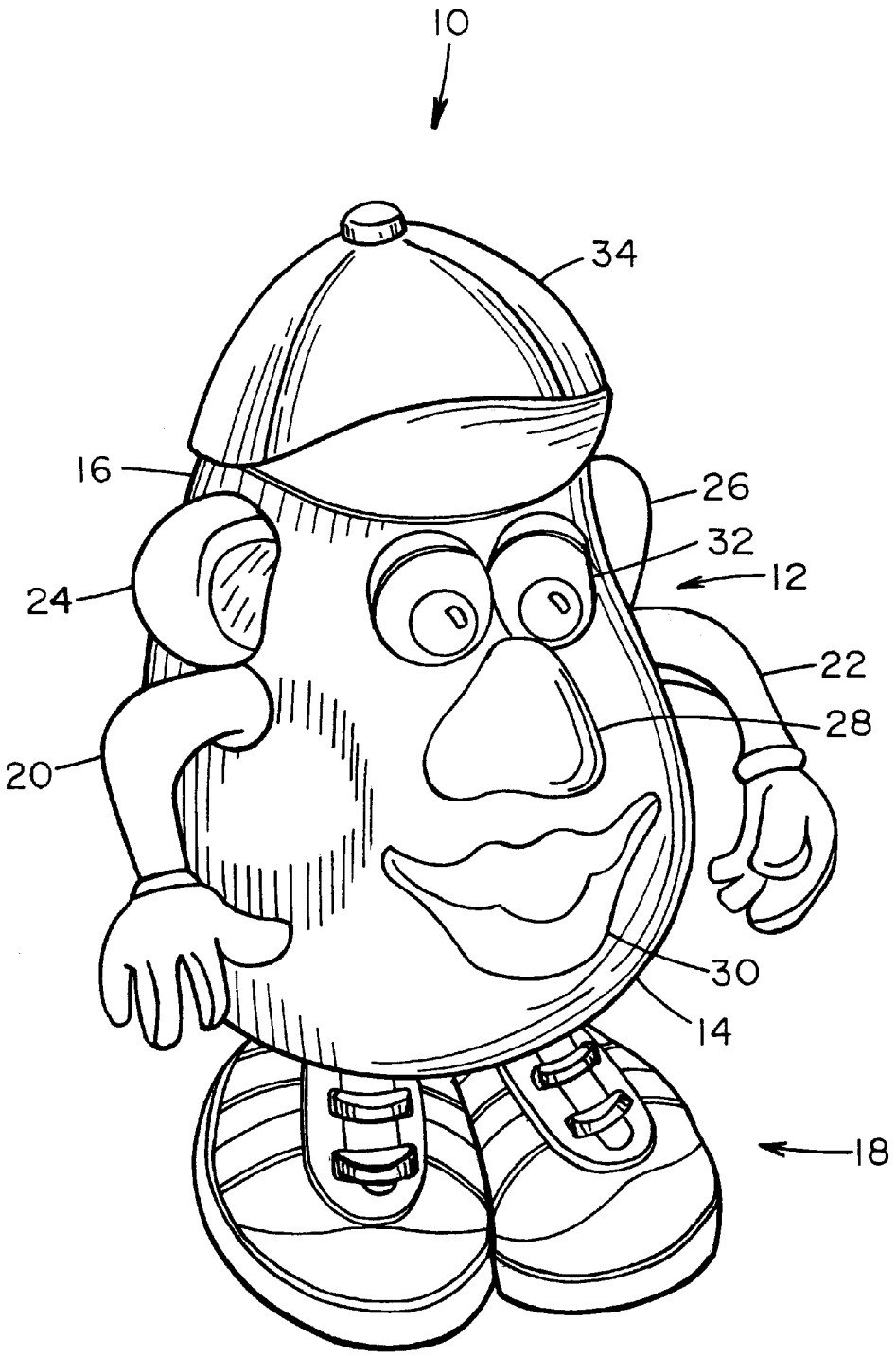
FIG. 1 illustrates an isometric view of an embodiment of a talking toy in accordance with the invention.

FIG. 1 illustrates an isometric view of an embodiment of a talking toy 10 in accordance with the invention. The toy 10 includes a body portion 12 having a front half 14 and a back half 16, a base portion 18 for maintaining the toy 10 in an upright position when rested on a surface, and a plurality of appendages 20–34 that are detachably combined with the body portion 12. The body portion 12 may be made of a thermoplastic material or any other suitable material. Similarly, the appendages 20–34 may be made of thermoplastic and/or elastomeric materials to be both safe and durable in typical play activities with children. The body portion 12 is generally shaped like an animated potato but may alternatively be shaped to represent a variety of other animated figures to achieve a desired entertainment quality or novelty. The appendages 20–34 are generally shaped to represent human body parts and apparel; however, other types of appendages may be included as needed to be consistent with the particular animated figure represented by the toy 10. For example, the appendages 20–34 could include representations of tools, weapons, animal body parts, etc.

Figure 2:
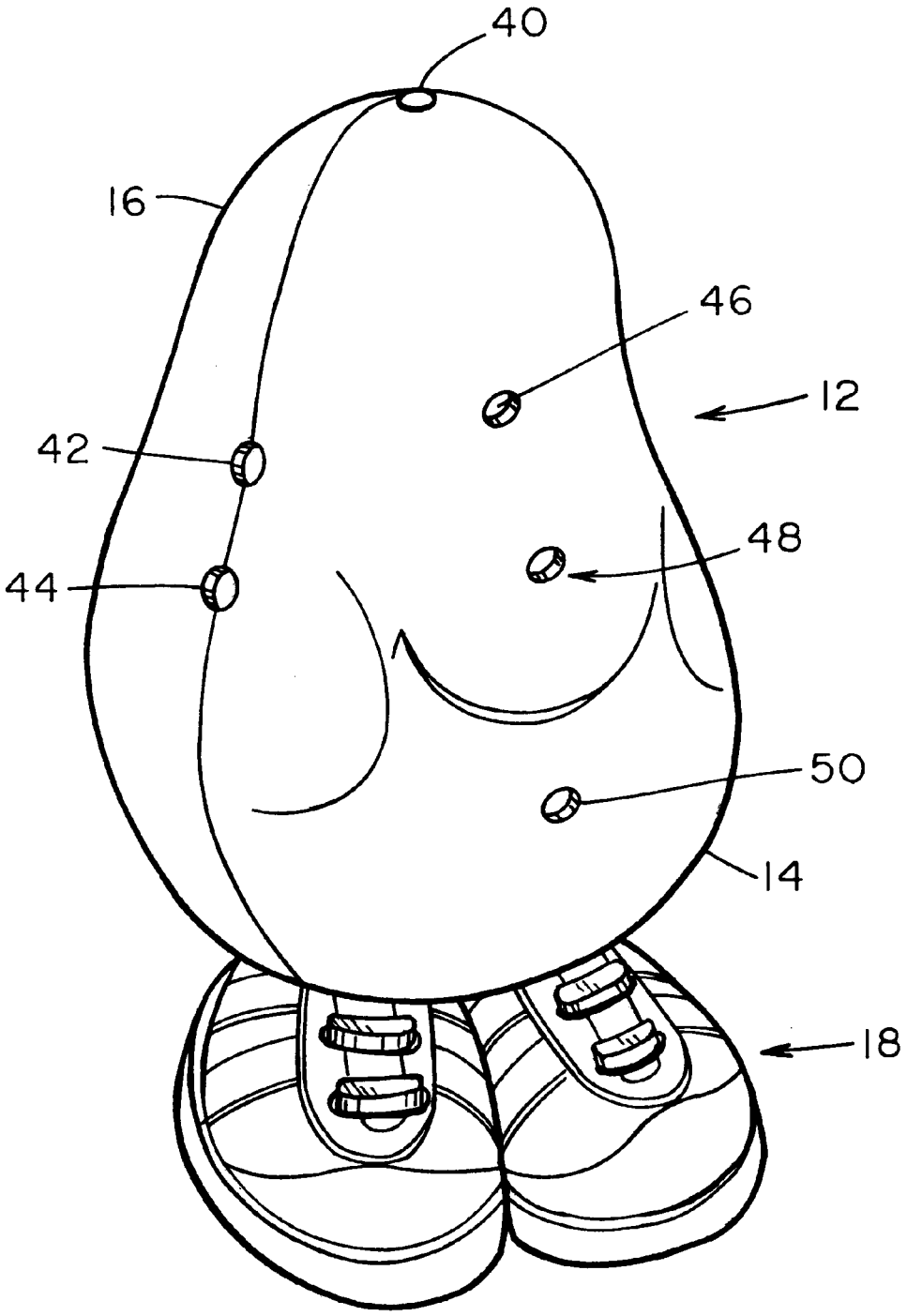
FIG. 2 illustrates some possible locations for a plurality of apertures in the body of the toy shown in FIG. 1.
Figure 6:
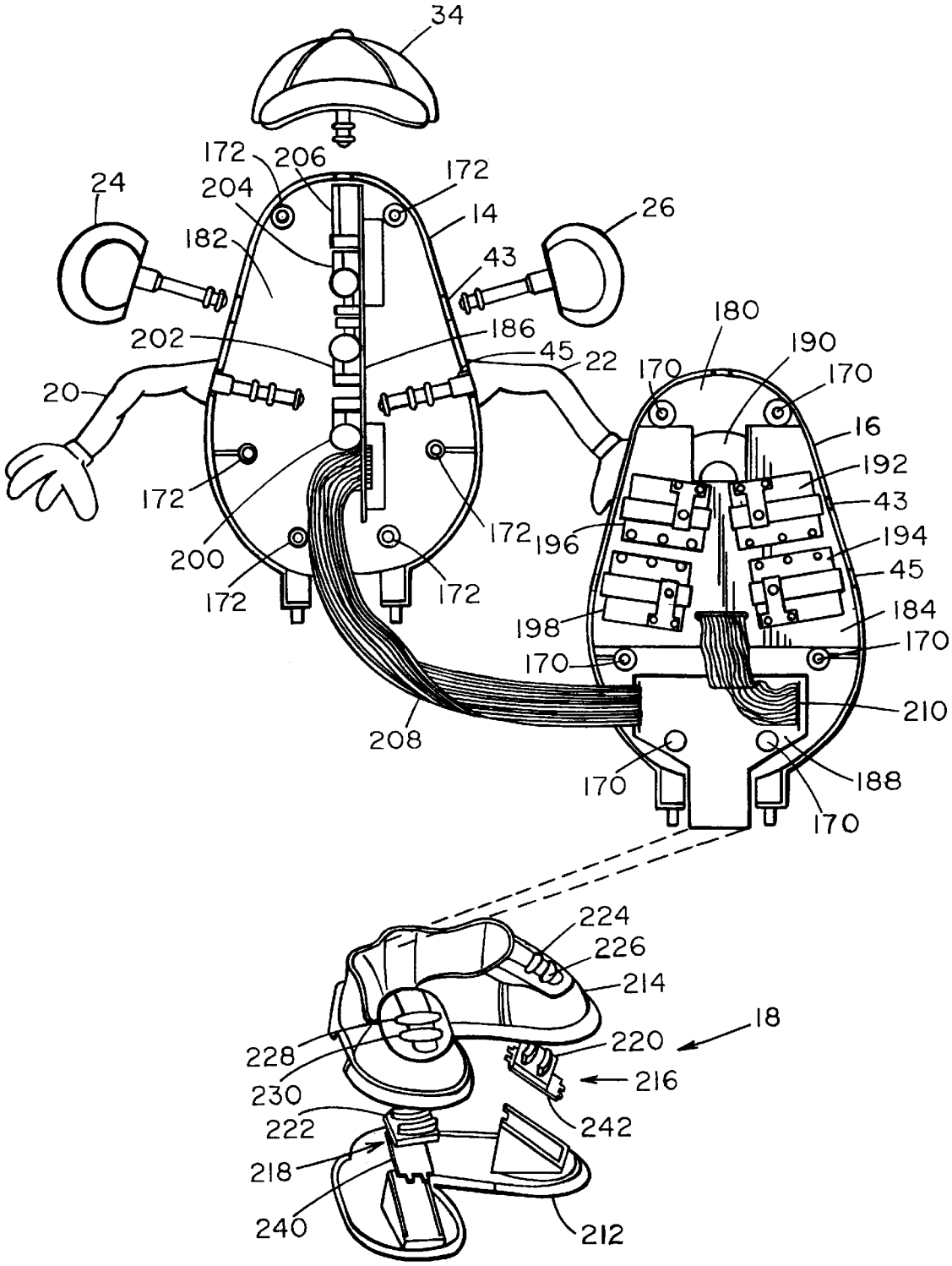
FIG. 6 illustrates an exploded isometric view of the toy shown in FIGS. 1 and 2.

FIG. 2 illustrates some possible locations for a plurality of apertures 40–50 (two of which are shown in FIG. 6) in the body portion 12 of the toy 10 shown in FIG. 1. The apertures 40–50 are of substantially the same size and are dimensioned to detachably receive key portions 120 (FIG. 4) of the appendages 20–34 (FIG. 1). The apertures 40–50 are located on the body portion 12 so that, at least in one configuration, the appendages 20–34 may be combined with the body portion 12 to represent the animated potato figure shown in FIG. 1. While a total of eight apertures 40–50 are shown, additional or fewer apertures may be included as needed without departing from the scope of the invention.

FIGS. 3A–3D illustrate exemplary appendages 20, 24, 33, 34 for detachably combining with the body portion 12 of the toy 10 shown in FIGS. 1 and 2. The appendages 20, 24, 33, 34 include the key portions 70–76 that are of substantially the same size and that protrude from the appendages 20, 24, 33, 34. The key portions 70–76 include encoded portions 78–84 having contours defined by raised portions 86–108 that are laterally spaced along the lengths of the key portions 70–76.

FIG. 4 illustrates a detailed elevational view of an exemplary key portion 120 that may be used with the appendages 20–34. The key 120 has a base portion 122, an encoded portion 24, and a head portion 126. The key 120 may be made from a relatively hard self-lubricating thermoplastic material such as Teflon® so that the key 120 may be more easily inserted/removed from the apertures 40–50. The encoded portion 24 includes concentric rings 128–136 that surround the longitudinal axis of the key 120. The rings 128–136 may be integrally molded with the key 120. The concentric rings 128–136 are laterally spaced along the length of the key 120 to form raised portions 138–146 in first through fifth predetermined locations 148–156. As discussed in more detail below, the first through fourth predetermined locations 148–154 are associated with identification of the appendages 20–34 and the fifth location 156 is associated with confirming the proper insertion of the key portion 120 into one of the apertures 40–50 on the body 12 of the toy 10.

Generally speaking, the first through fourth predetermined locations 148–154 may be used to mechanically encode the key 120 to identify the particular appendage that is associated with the key 120. Namely, a concentric ring may be included or not included at each of the first through fourth locations 148–154 to define a contour along the encoded portion 124 that represents a binary code uniquely associated with the appendage. For instance, the presence of a ring may correspond to a logical "1" and the absence of a ring may correspond to a logical "0." Thus, a key may include rings at the first and third locations to represent a binary code of "1010." Because a ring may be present/not present in each of the first through fourth locations 148–154, there are sixteen possible contours/binary codes, which may be used to identify appendages.

FIG. 5 illustrates one possible assignment of binary codes to the appendages 20–34. Some of the appendages 20–34 may have the same binary code assignment. For example, the left and right arms 20, 22 (FIG. 1) are assigned the same code and, similarly, the ears 24, 26 (FIG. 1) are assigned the same code. While four locations and sixteen possible codes (i.e., contours) are described in connection with the invention, it would be possible to define more of fewer locations to provide more or fewer unique codes for assignment to the appendages 20–34.

FIG. 6 illustrates an exploded isometric view of the toy 10 shown in FIGS. 1 and 2. The front and back halves 14, 16 of the body 12 are fastened together with screws that pass through access holes 170 and thread into bosses 172. The halves 14, 16 of the body 12 form hollow portions 180, 182 that contain a lateral circuit assembly 184, a transverse circuit assembly 186, a voice generating circuit assembly 188, and a speaker 190. The circuit assemblies 184–188 are mechanically secured to the back half 16 of the body 12 with screws that pass through holes (not shown) in the circuit assemblies 184188 and into bosses (not shown) that are integrally molded with the back half 16 of the body portion 12.

The lateral circuit assembly 184 includes encoders 192–198 that are associated with the ear and arm aperture locations 42–45 on the body 12, respectively. Likewise, the transverse circuit assembly 186 includes encoders 200–206 that are associated with the hat, eyes, nose, and mouth apertures 40, 46, 48, 50, respectively. The encoders 192–206 are fastened to their respective circuit assemblies with screws (not shown).

The voice generating circuit assembly 188 is coupled to a source of battery power 304, 306 (FIG. 7), the encoders 192–206, and the speaker 190. The circuit assemblies 184–188 may be fabricated using a variety of known printed circuit and component technologies including through-hole, surface mount, hybrid, wire-bonded die-down, etc. without departing from the scope of the invention. Additionally, the circuit assemblies 84–188 are electrically interconnected with ribbon cabling 208, 210 or other suitable conductors.

The base portion 18 includes a base plate 212 that is attached to a base cover 214 with screws that thread into bosses, and a pair of momentary switches 216, 218 that are integrally mounted in the base 18. The momentary switches 216, 218 include tandem switch buttons 220, 222 that extend through openings 224–230 in the base cover 214. The switch buttons 220, 222 may be pressed by the user so that conductive portions of elastomeric switch members (not shown) are urged into contact with conductive pads on printed circuit boards 240, 242. As is generally known in the art, surfaces of the elastomeric switch members may be coated with conductive materials, and the printed circuit boards 240, 242 may include laterally spaced pairs of conductive contact pads located opposite the conductive portions of the elastomeric switch members. Thus, as the user urges the elastomeric switch member into contact with the circuit board, an electrical path is formed between the spaced contact pads on the circuit board. The elastomeric quality of the switch members provides a return force so that when the user releases the buttons 220, 222 the elastomeric switch members return to a relaxed condition in which the conductive pad no longer completes the electrical path between the conductive pads. The momentary switches 216, 218 are electrically connected to the voice generating circuit assembly via wires; however, other connector types such as ribbon cabling, pins and sockets, etc. may be used.

Figure 7:
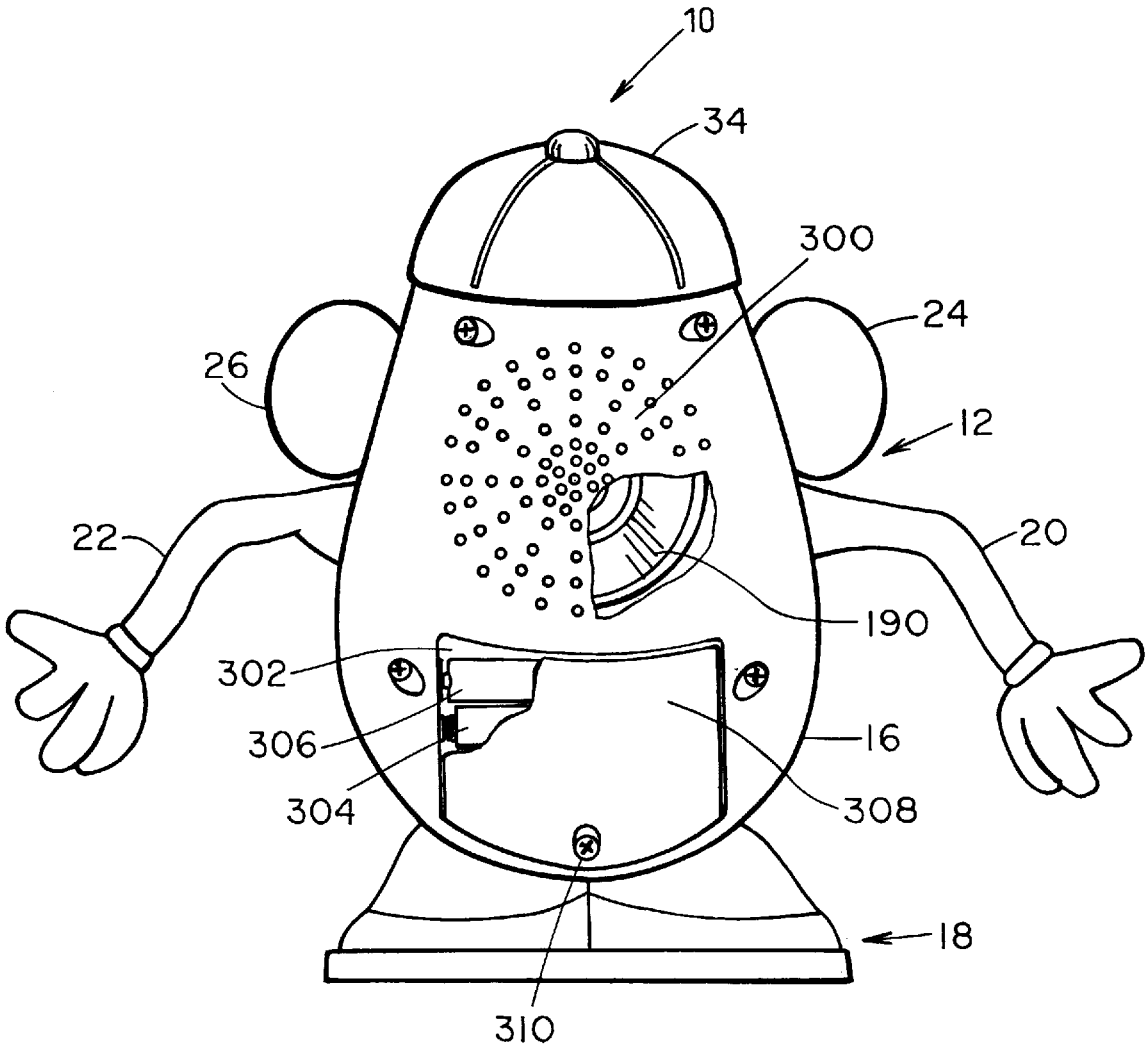
FIG. 7 illustrates a rear elevational view, partially in section, of the toy shown in FIGS. 1, 2 and 6.

FIG. 7 illustrates a rear elevational view, partially in section, of the toy 10 shown in FIGS. 1, 2 and 6. The back half 16 of the body 12 includes a perforated area 300 that allows sounds generated by the speaker 190 to readily pass through the body 12. A compartment 302 contains batteries 304, 306 that supply power to the circuit assemblies 184–188. A removable access panel 308 is secured in place with a screw 310 to cover the batteries 304, 306 during normal use of the toy 10 and to prevent a child from gaining access to the batteries 304, 306.

While screws are shown fastening together various components of the toy 10, other fastening techniques may be employed without departing from the scope of the invention. For example, press-fit and snap-fit type fastening techniques may be used to keep assembly and material costs low. Alternatively, fast-cure adhesives, ultrasonic welds and/or other similar or equivalent fastening techniques that are commonly known in the art may be used.

FIG. 8 illustrates a more detailed isometric view, partially in section, of the encoders 192–206 shown in FIG. 6.

One of the encoders 192 is shown in FIG. 8 to include an upper housing 352, a lower housing 354, a contact plate 356, and a retainer assembly 358. The upper and lower housings 352, 354 are fastened together with rivets to form an aperture 357 that is dimensioned to receive the key portions 120 of the appendages 20–34. The encoder 192 is fastened to a printed circuit board 360 having conductive pads 362–370.

FIG. 9 illustrates a more detailed isometric view of the contact plate 356 shown in FIG. 8. The contact plate 356 includes a plurality of contact members 372–380 having beam portions 382–390, contact edges 392–400, and embedded followers 402–410. The contact plate 356 is captured between the upper and lower housings 352,354 so that hemispherical head portions 416 (FIG. 10) of the followers 402–410 protrude radially into the aperture 357 of the encoder 192. The contact plate 356 is made from a suitably springy conductive contact material such as stainless steel or plated bronze and may be stamped from a single blank in a progressive die, for example, to keep costs low.

The contact members 372–380 are spaced so that the followers 402–410 substantially coincide with the first through fifth locations 148–156 for the concentric rings on the keys 120 of the appendages 20–34. Likewise, the contact pads 362–370 on the printed circuit board 360 are aligned to coincide with the contact edges 392–400 of the contact members 372–380. Thus, when the key 120 is fully inserted into the aperture 357 of the encoder 192, the raised ring portions of the key 120 drive corresponding ones of the followers 402–410 and contact members 372–380 to cause corresponding ones of the contact edges 392–400 to come into conductive contact with the contact pads 362–370. The ring in the fifth location 156, which is always present, drives the corresponding contact edge 400 into contact with the fifth contact pad 370 to confirm insertion of the key 120.

Each of the sixteen possible combinations of concentric rings (or absence of rings) actuates a different combination of the contact members 372–380 to cause a different combination of contact edges 392–400 to come into contact with the contact pads 362–370. In this manner, the encoder 192 converts the binary codes represented by the first through fourth locations 48–154 on the keys 120 of the appendages 20–34 into corresponding combinations of electrical contact closures that may be processed by the voice generating circuit assembly 188, as discussed in greater detail below.

FIG. 10 illustrates a fragmentary sectional view 412 of the followers 402–410 shown in FIGS. 8 and 9. The followers 402–410 have a hemispherical head portion 416 and a post portion 418 that is pressed into an opening 420 in the beam portions 382–390 of the contact members 372–380. To increase durability of the encoder 192 and minimize the force required to insert the key 120 into the aperture 357, the followers 402–410 may be made from a self-lubricating thermoplastic material such as Teflon®, or any other suitable material. Alternatively, the followers 402–410 may be integrally formed in the beam portions 382–390 by semi-perforating the material of the beam portions 382–390 during fabrication of the contact plate 356.

Referring to FIG. 8, the retainer assembly 358 includes a flat spring 424 having a retaining pin 426. The flat spring 424 is attached to the upper housing 352 via mounting posts 425 that pass through mounting holes in the spring 424 and which are deformed to form retaining heads that securely maintain the flat spring 424 in position. The retaining pin 426 extends radially into the aperture 357 of the encoder 192 so that when the key 120 is fully inserted into the aperture 357, the retaining pin 426 traps the head portion 126 of the key 120. Thus, removal of the inserted key 120 requires the user to overcome the retaining force of the retainer assembly 358. As a result, any appendages attached to the body 12 will tend to remain in place until the user forcibly removes them.

Figure 11:
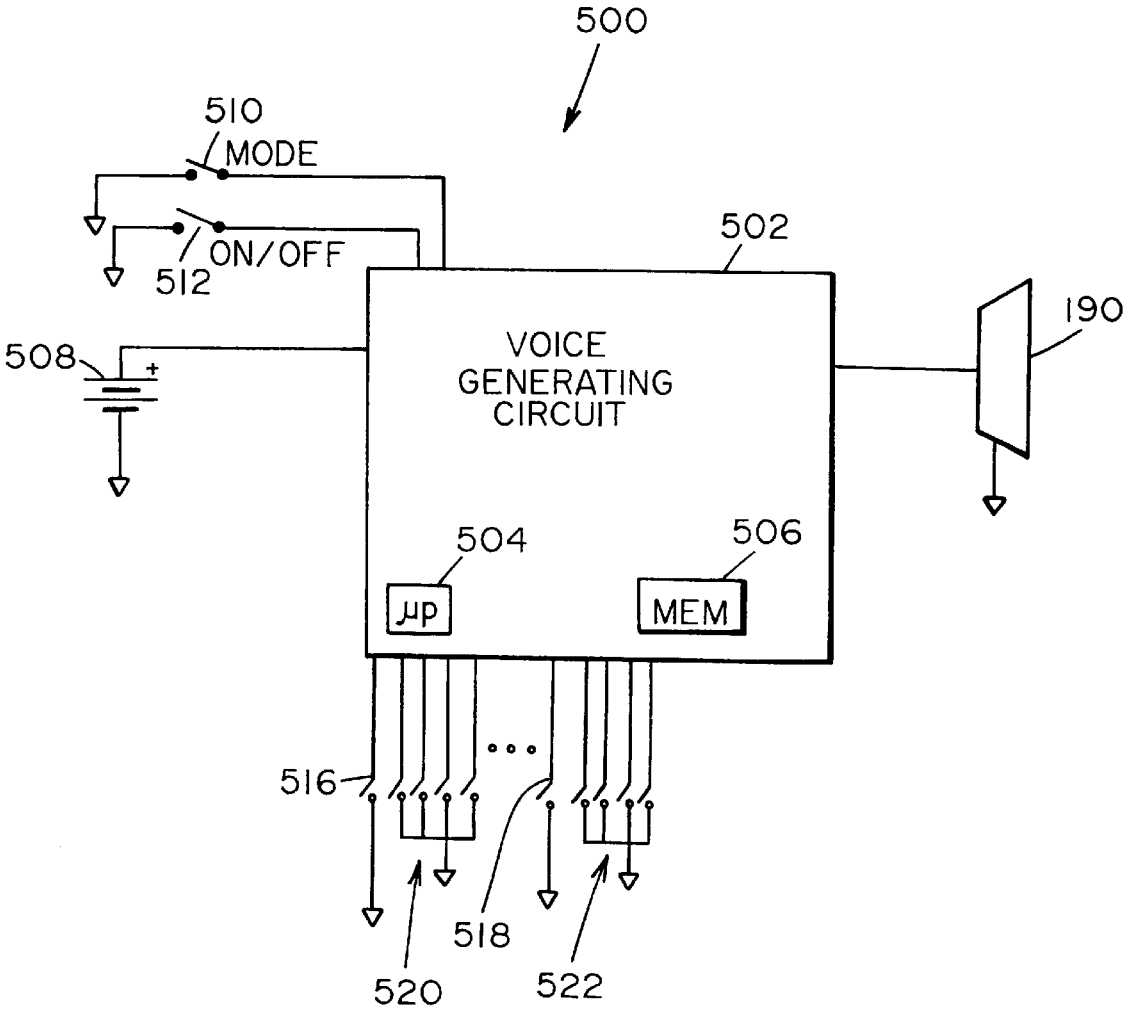
FIG. 11 is a schematic diagram of a portion of a circuit that may be used in controlling the operation of the toy shown in FIGS. 1, 2 and 6.

FIG. 11 is a schematic diagram of a portion of a circuit 500 that may be used in controlling the operation of the toy 10 shown in FIGS. 1, 2 and 6. The circuit 500 may reside on one or more of the above-described circuit assemblies 184–188 and includes a voice generating circuit 502 having a microprocessor 504 and a memory 506, a battery 508, a mode switch 510, an on/off switch 512, the speaker 190, which may be a conventional permanent magnet/moving coil type speaker, for example, a plurality of confirmation switches 516, 518, and a plurality of binary code switches 520, 522, all coupled together as shown. The binary code switches 520, 522 and the confirmation switches 516, 518 correspond to the contact closure outputs of the encoders 192–206. The on/off switch 512 provides a momentary switching action to electronically toggle the voice generating circuit 188 on and off to activate/deactivate the operation of the toy 10.

Generally, the microprocessor 504 executes software stored in the memory 506 that uses the binary code signals provide by the binary code switches 520, 522 to recognize the presence of particular key portions 120 in particular ones of the apertures 40–50 and to provide voice messages to the user based on the particular combinations of the appendages 20–34 and the apertures 40–50. For example, one of the arm appendages 20, 22 may be inserted into the any of the apertures 40–50, and the voice generating circuit 502 will recognize where the arm appendage is located on the body portion 12 and may provide a different voice message response for each of the combinations of the arm with the different apertures 40–50.

Additionally, the software executed by the processor 504 may be organized in various levels that cooperate by exchanging messages. These levels may include a generic data/input/output level that receives and routes information related to the presence of particular ones of the appendages 20–34 in particular ones of the apertures 40–50 on the body 12 of the toy 10. A game level may receive and process messages posted by the data/input/output level to execute a state machine type control of an entertaining game and/or interactive play characteristic.

Figure 12:
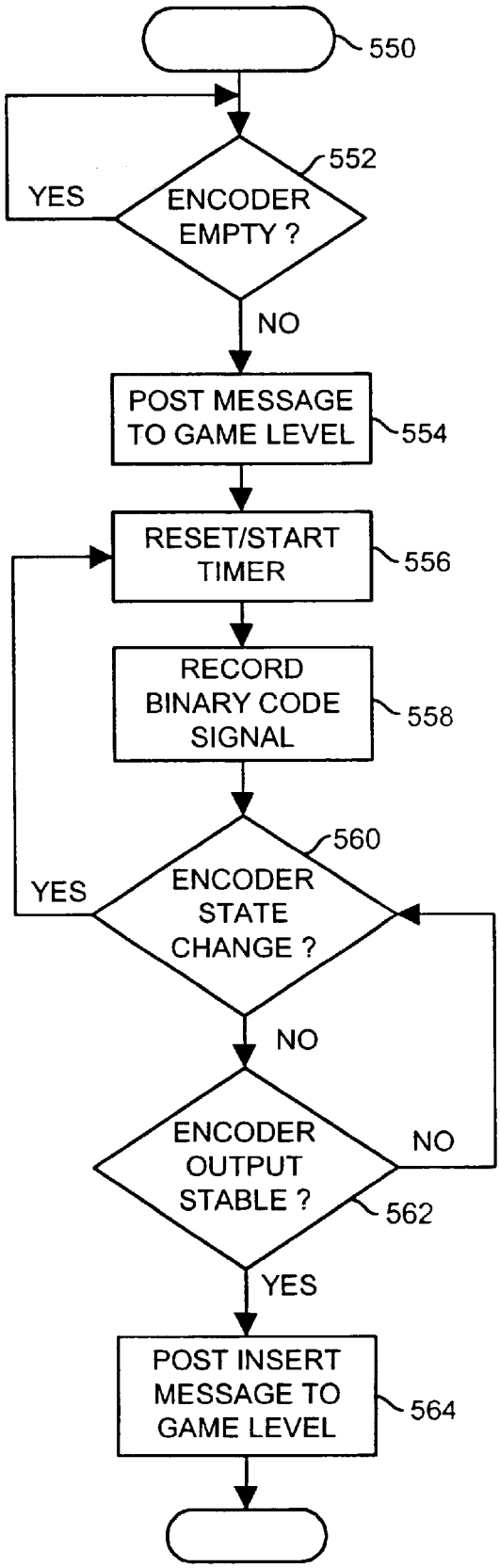
FIG. 12 is a flow diagram representing a method of recognizing the insertion of an appendage key into the body of the toy shown in FIGS. 1, 2 and 6.

FIG. 12 is a flow diagram representing an exemplary method 550 of recognizing the insertion of the appendage keys 120 into the apertures 40–50 of body 12 of the toy 10 shown in FIGS. 1, 2 and 6. The flow diagram will be discussed with respect to the encoder 192 shown in FIGS. 8–10; however, the method 550 represented by the flow diagram may be generally applied to any of the encoders 192–206.

In step 552 the processor 504 checks if the encoder 192 is empty. If none of the contact members 372–380 is in electrical contact with the contact pads 362–370 of the circuit board 360 then the encoder 192 is treated as empty and the processor 504 reenters step 552. If the encoder 192 is not empty the processor 504 enters step 554 and posts a non-zero message to the game level. A non-zero message may be used at the game level to play an insertion noise such as a "squish" sound while a key is being inserted and during a stabilization delay (as discussed below) following the insertion of the key. In step 556 the processor 504 resets and starts a timer.

In step 558 the processor 504 reads and records in the memory 506 the current binary code signal being provided by the encoder 192, and in step 560 compares the current binary code signal to a previously saved binary code signal received from the encoder 192 to determine if the encoder state has changed. If the encoder state has changed, the processor 504 returns to step 556, otherwise the processor 504 enters step 562 to determine if the present encoder output represents a stable value. The processor 504 determines stability by cycling through steps 560 and 562 until a predetermined amount of time has elapsed in which the encoder output state does not change. Once the processor 504 has determined that the encoder output is stable, the processor 504 enters step 564 and posts an "INSERT APPENDAGE" message to the game level. A method similar to the above-described method 550 may be used to recognize the removal of an appendage key from any of the apertures 40–50 on the body 12 of the toy 10.

Figure 13:
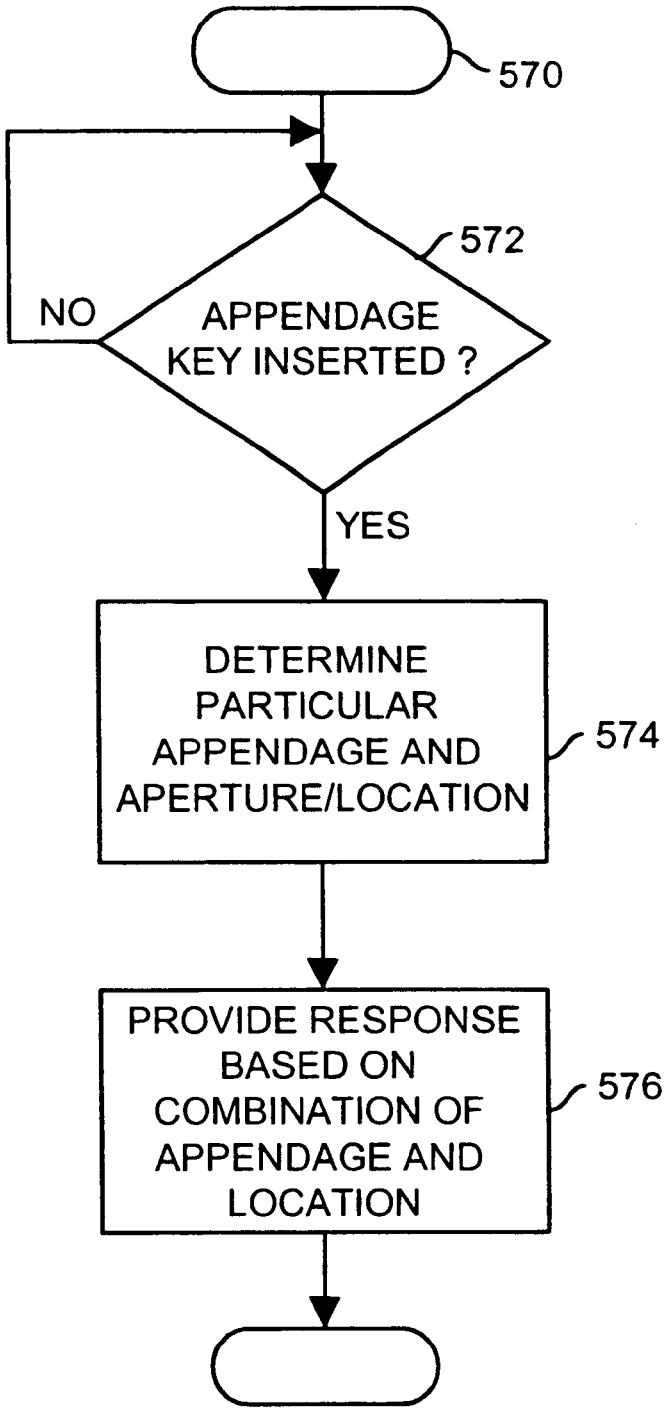
FIG. 13 is a flow diagram representing a method of providing responses to a user based on the combination of a particular appendage with a particular aperture in the toy shown in FIGS. 1, 2 and 6.

FIG. 13 is a flow diagram representing a method 570 of providing responses to a user based on the combination of a particular appendage with a particular aperture in the toy shown in FIGS. 1, 2 and 6. In step 572 the processor 504 determines if an appendage has been inserted by, for example, receiving an "INSERT APPENDAGE" message from the data/input/output level. If an appendage has been inserted the processor 504 determines in step 574 the particular appendage inserted via the binary code provided by the encoder 192 and determines the particular aperture in which the appendage has been inserted. In step 576 the processor 504 provides a voice message response that is associated with the combination of the particular appendage and the particular aperture with which the particular appendage is combined.

The basic I/O and message generating techniques in combination with the above-described apparatus may be used to create a variety of interactive play modes having a variety of desired novel entertainment qualities. For example, the mode switch may be used to select between "toy mode" and "game mode" operation. In toy mode, a user combines and removes appendages 20–34 with the body 12 at will and receives voice messages based on the particular combinations of appendages 20–34 and apertures 40–50. For example, if the user combines one of the arm appendages 20, 22 with the nose aperture 48, the toy may provide a voice message that includes an elephant noise and a request for "some peanuts."

In game mode, a game called "Mr. Potato Head Says" (i.e., similar to "Simon Says") may be played by one or more users. In this game, the toy 10 generally requests the attachment of a particular appendage to the body 12 with or without the appropriate preface "Mr. Potato Head Says." If the user responds correctly, a rewarding voice message is provided to the user, and if the user responds incorrectly an appropriate voice message is provided. The voice messages may include scoring capability together with humorous commentary to keep play interesting for both children and adults.

In game mode, the toy 10 may recognize that one of the arms 20, 22 is already attached to the body 12 and will provide appropriate voice messages when asking for the other arm. For instance, the toy 10 may say "Mr. Potato Head says put in my other arm." Additionally, because the appendages 20–34 include two ears 24, 26, the toy 10 may request attachment of a second ear in a similar manner.

Some embodiments may allow the animated figure represented by the toy 10 to exhibit certain characteristics and/or to provide voice message responses selected from predefined groups of messages based on the specific form an attached appendage. For example, the toy 10 may use voice responses with a tag line such as "Hey Partner" when a cowboy hat appendage is combined with the head aperture 40, and, alternatively, may use voice responses with a tag line such as "Hey Matey" when a pirate hat appendage is combined with the head aperture 40. In game mode, the toy 10 may be adapted to request that a hat be attached or that hats be changed on a frequent basis so that a greater variety of the voice messages are played to keep users interested.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A talking toy, comprising:

a body portion having a plurality of apertures of substantially the same size therein;

a plurality of encoders, each of the encoders having a plurality of contact members and being uniquely associated with one of the apertures;

a plurality of appendages for detachably combining with the body, each of the appendages having a key portion protruding therefrom, the key portions being of substantially the same size so that each of the key portions will fit in at least two of the apertures, the key portions including encoded portions having contours uniquely associated with the appendages such that each of the key portions actuates a combination of the contact members to generate a predetermined binary code signal associated with the appendage upon insertion into one of the apertures;

a source of battery power disposed within the body;

a speaker disposed within the body; and a voice generating circuit coupled to the battery power, the encoders, and the speaker and having a plurality of voice messages associated therewith, the voice generating circuit being adapted to use the binary code signals to recognize the presence of a particular one of the key portions in a particular one of the apertures and to play at least one of the voice messages based on the combination of the binary code signal and the aperture.

2. The toy of claim 1, wherein two of the appendages are arms having substantially identical encoded portions.

3. The toy of claim 1, wherein at least one of the appendages is a character appendage that causes the voice generating circuit to play messages selected from a predetermined group of messages based on the specific form of the character appendage.

4. The toy of claim 3, wherein the character appendage is representative of a hat.

5. The toy of claim 1, wherein the encoded portion comprises one or more raised portions laterally spaced along a length of the key portion.

6. The toy of claim 5, wherein the raised portions are concentric rings surrounding an axis of the key portion.

7. The toy of claim 1, wherein at least some of the appendages are representative of human body parts.

8. The toy of claim 1, wherein at least some of the appendages are representative of apparel.

9. The toy of claim 1, further comprising a plurality of confirmation switches coupled to the voice generating circuit, each of the confirmation switches being uniquely associated with one of the apertures and adapted to detect the proper insertion of the key portions into the apertures.

10. A talking toy having a body including a hollow portion containing a source of battery power, a speaker, and an electrical circuit, the toy comprising:

a body portion shaped to represent an animated figure and having a plurality of apertures of substantially the same size therein, the apertures being associated with a plurality of predetermined locations on the body;

a plurality of appendages for detachably combining with the body, the appendages having key portions protruding therefrom, the key portions being of substantially the same size so that each of the key portions will fit in at least two of the apertures;

a first circuit portion disposed within the body portion and adapted to recognize the presence of particular appendages in particular locations on the body; and a second circuit portion disposed within the body portion and having a plurality of voice messages associated therewith, the second circuit portion being adapted to play the voice messages based on the combinations of particular appendages and locations.

11. The toy of claim 10, wherein two of the appendages are arms having substantially identical key portions.

12. The toy of claim 10, wherein at least one of the appendages is a character appendage that causes the second circuit portion to play messages selected from a predetermined group of messages based on the specific form of the character appendage.

13. The toy of claim 12, wherein the character appendage is representative of a hat.

14. The toy of claim 10, wherein at least some of the appendages are representative of human body parts.

15. The toy of claim 10, wherein at least some of the appendages are representative of apparel.

16. A talking toy, comprising:

a body portion generally shaped like an animated potato and having a plurality of apertures therein;

a plurality of electromechanical encoders, wherein each of the electromechanical encoders has a plurality of contact members and wherein each of the electromechanical encoders is uniquely associated with one of the apertures;

a first appendage generally shaped like a right arm, wherein the first appendage is adapted to detachably combine with the body portion and has a first key portion protruding therefrom that includes a first mechanically encoded portion uniquely configured for the first appendage, and wherein the first mechanically encoded portion is adapted to actuate one or more of the contact members upon insertion into one of the apertures;

a second appendage generally shaped like a left arm, wherein the second appendage is adapted to detachably combine with the body portion and has a second key portion protruding therefrom that includes a second mechanically encoded portion uniquely configured for the second appendage, and wherein the second mechanically encoded portion is adapted to actuate one or more of the contact members upon insertion into one of the apertures;

a third appendage, wherein the third appendage is adapted to detachably combine with the body portion and has a third key portion protruding therefrom that includes a third mechanically encoded portion uniquely configured for the third appendage, and wherein the third mechanically encoded portion is adapted to actuate one or more of the contact members upon insertion into one of the apertures;

a speaker disposed within the body; and a voice generating circuit coupled to the speaker that is adapted to recognize the presence of a particular one of the appendages in a particular one of the apertures and to play a voice message in response thereto.

17. A talking toy, comprising:

a body portion having a plurality of apertures therein;

a plurality of electromechanical encoders, wherein each of the electromechanical encoders has a plurality of contact members;

a plurality of appendages for detachably combining with the body portion, wherein each of the appendages has a key portion protruding therefrom and wherein each of the key portions includes a mechanically encoded portion uniquely associated with that appendage, the mechanically encoded portions being adapted to actuate one or more of the contact members;

a speaker disposed within the body; and a voice generating circuit coupled to the speaker that is adapted to recognize the presence of a particular one of the appendages in a particular one of the apertures and to play a voice message in response thereto.

18. A talking toy, comprising:

a body portion generally shaped like an animated potato and having a plurality of apertures therein;

a first appendage generally shaped like a right arm, wherein the first appendage is adapted to be detachably combined with the body portion and wherein the first appendage has a first uniquely configured mechanical key portion protruding therefrom for insertion into the apertures;

a second appendage generally shaped like a left arm, wherein the second appendage is adapted to be detachably combined with the body portion and wherein the second appendage has a second uniquely configured mechanical key portion protruding therefrom for insertion into the apertures;

a third appendage, wherein the third appendage is adapted to be detachably combined with the body portion and wherein the third appendage has a third uniquely configured mechanical key portion protruding therefrom for insertion into the apertures;

a first circuit portion disposed within the body portion and adapted to recognize the presence of particular one of the appendages in particular locations on the body portion; and a second circuit portion disposed within the body portion and having a plurality of voice messages associated therewith, the second circuit portion being adapted to play the voice messages in response to combinations of particular ones of the appendages and locations.

* * * * *